United States Patent [19]

Larson

[11] 4,391,245

[45] Jul. 5, 1983

[54] PRESSURE OPERATED THREE-POSITION THROTTLE STOP ASSEMBLY

[75] Inventor: William C. Larson, Rochester, Mich.

[73] Assignee: Colt Industries Operating Corp., New York, N.Y.

[21] Appl. No.: 312,392

[22] Filed: Oct. 19, 1981

[51] Int. Cl.[3] ..... F02M 3/00

[52] U.S. Cl. ..... 123/339; 123/341; 123/389

[58] Field of Search ..... 123/336, 340, 376, 378, 123/389, 401, 339, 341; 180/175-177

[56] References Cited

U.S. PATENT DOCUMENTS 4,220,218 9/1980 Riddel ..... 123/401
4,230,077 10/1980 Ito ..... 123/378

FOREIGN PATENT DOCUMENTS 2801270 9/1978 Fed. Rep. of Germany ..... 123/378

*Primary Examiner*—William A. Cuchlinski, Jr.
*Attorney, Agent, or Firm*—Walter Potoroka, Sr.

[57] ABSTRACT

A throttle stop assembly is shown having a body or housing containing a diaphragm therein which serves to define within such housing a relatively high pressure or atmospheric chamber at one side of the diaphragm and a relatively low pressure or vacuum chamber at the other side of the diaphragm; the vacuum chamber is provided with at least one interior wall against which the diaphragm member is brought when a first magnitude of vacuum is admitted to the vacuum chamber as to thereby correspondingly position a related movable throttle stop member; when a second magnitude of vacuum is admitted to the vacuum chamber a portion of the diaphragm is moved further toward and operatively against a second wall or abutment as to thereby again correspondingly position the related movable throttle stop member.

18 Claims, 4 Drawing Figures

PRESSURE OPERATED THREE-POSITION THROTTLE STOP ASSEMBLY

FIELD OF THE INVENTION

This invention relates generally to pressure operated motor means and more particularly to such motor means employing pressure responsive movable diaphragm means. In one particular aspect, the motor means is employed as a variable position throttle stop means for an induction system for a combustion engine.

BACKGROUND OF THE INVENTION

Heretofore, it has been accepted prior art practice to provide what was generally referred to as a fast idle cam which was positioned generally in accordance with the position of the choke valve of an associated carburetor. As is well known in the art, such choke valves were and are usually positioned in accordance with engine temperature. The cam, thusly positioned, coacts with a swingable abutment operatively connected to the engine throttle valve as to thereby be effective for holding the throttle valve open a greater degree during cold engine idle operation while permitting a lesser degree of throttle opening at engine idle once the engine has attained some preselected operating temperature.

Generally, in the past, such prior art arrangements have been found to be adequate. However, because of governmentally imposed standards, among other things, engines have steadily become smaller (of reduced displacement and power) while the consumer still continues to require such vehicular accessories as, for example, air conditioning units and the like which, when used, apply a disproportionate load on the smaller engine especially during idle engine operation. The extra load thusly placed on the engine, at idle operation, is often sufficient to stall the engine or, the very least, cause unacceptably rough engine operation. This, of course, applies to situations where normal engine operating temperature has been attained and therefore, there is no way in which the prior art fast idle cam (positioned by the choke valve) is able to assist the engine in compensating for the additional accessory load.

Further, it has been discovered that certain engines, upon vehicle deceleration, are to a significant degree driven by the vehicle to where exceptionally high magnitudes of intake manifold are created which, in turn, causes excessive fuel to be delivered into the engine induction passage means from the idle fuel metering system. This results in, among other things, increased fuel consumption, which coupled with a relatively small rate of air flow causes, in those vehicles so equipped, overheating of the exhaust catalytic converter.

The invention as herein disclosed and described is, among other things, directed to the solution of the foregoing and related and attendant problems of the prior art.

SUMMARY OF THE INVENTION

According to the invention apparatus for variably stopping the closing movement of throttle valve means controlling the flow of motive fluid to an associated combustion engine comprises variably positionable abutment means effective for operative engagement with said throttle valve means when said throttle valve means is moved toward a closed position, resilient means effective for moving said abutment means to a first position whereat said throttle valve means when moved toward said closed position operatively engages said abutment means to thereby be held open a relatively small first amount, and pressure responsive movable wall means effective upon being exposed to a first magnitude of vacuum generated by said engine for moving said abutment means to a second position whereat said throttle valve means when moved toward said closed position operatively engages said abutment means to thereby be held open a relatively larger second amount, said pressure responsive movable wall means being effective upon being exposed to a second magnitude of vacuum greater than said first magnitude and generated by said engine for moving said abutment means to a third position whereat said throttle valve means is held open a relatively greatest third amount.

Various general and specific objects, advantages and aspects of the invention will become apparent when reference is made to the following detailed description of the invention considered in conjunction with the accompanying drawings.

BRIEF DESCRIPTION OF THE DRAWINGS

In the drawings wherein for purposes of clarity certain details may be omitted from one or more views.

DETAILED DESCRIPTION OF THE PREFERRED EMBODIMENT

Figure 1:
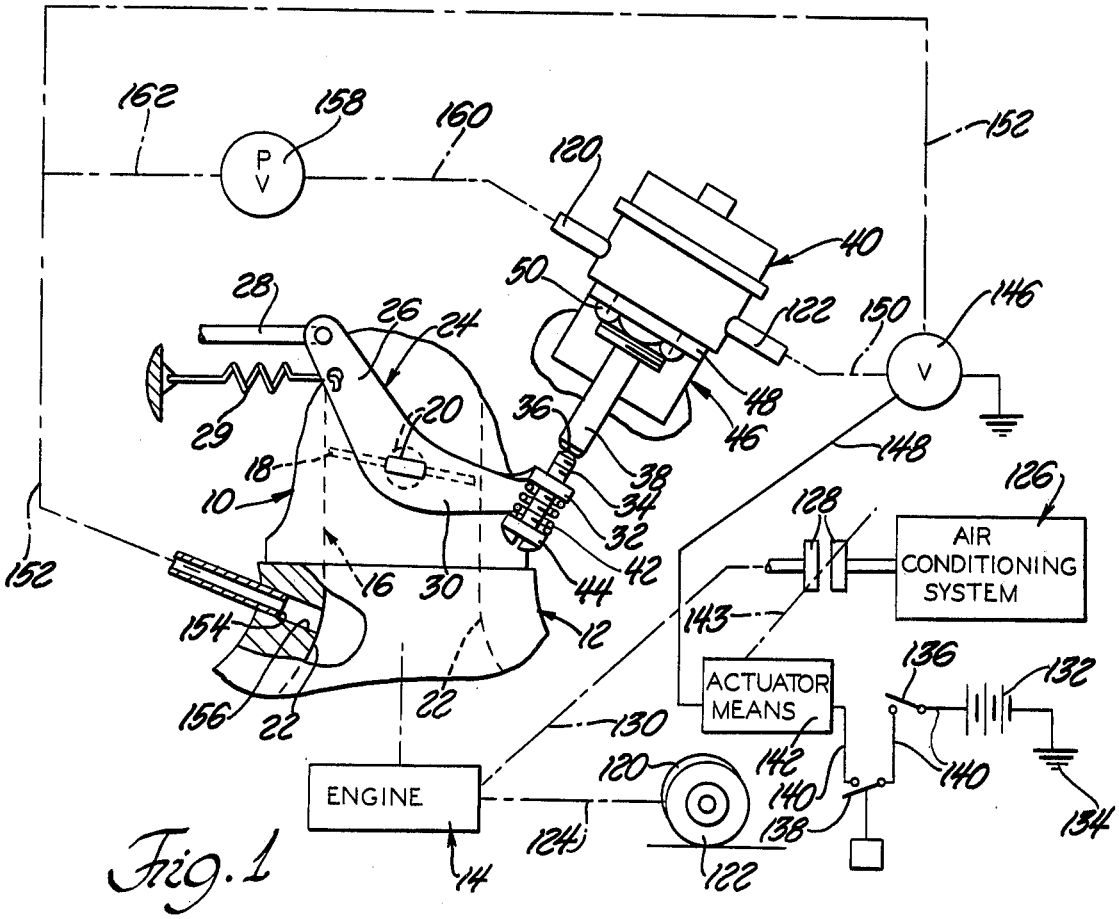
FIG. 1 is a partly schematic and partly diagrammatic view of a vehicle equipped with a throttle stop assembly employing teachings of the invention.

Referring now in greater detail to the drawings, FIG. 1 illustrates an induction apparatus, such as for example a carburetor 10, carried as atop an intake manifold 12 of an associated engine 14. As generally indicated the induction apparatus or carburetor 10 has induction passage means 16 formed therethrough with throttle valve means 18 situated therein and carried as by a pivotally rotatable throttle shaft 20. The throttle valve 18 is variably rotatably openable as to thereby accordingly control the flow of motive fluid through the induction passage 16 and into the intake passage 22 of engine intake manifold 12.

Throttle lever means 24, suitably secured to throttle shaft 20 for rotation therewith, has a first arm portion 26 to which suitable throttle actuating linkage means 28 is operatively connected and leading to, for example, the vehicle operator's throttle actuating foot pedal whereby movement of the linkage means 28, generally to the right, causes clockwise opening movement of the throttle valve means 18. As usual, suitable throttle return spring means 29 may be provided for assuring and causing the throttle means 18 to move toward its nominally closed position upon release by the vehicle operator. As generally depicted, such resilient or spring means 29 may be thought of as being operatively connected to lever arm portion 26 as to thereby urge counter-clockwise rotation of lever means 24 and throttle means 18.

An other arm 30 of lever 24 may be provided with an integrally formed generally transversely extending flange-like portion 32 which threadably carries a screw member 34 which has its end 36 effective for abutingly engaging a stop member 38 of the variable position throttle stop apparatus 40. A spring 42 may be carried generally about the shank of screw 34 and axially contained as between flange 32 and head 44 of screw 34 to thereby assist in frictionally retaining the screw 34 in its selected position relative to flange 32 and lever means 24. As generally depicted, the throttle stop apparatus 40 may be suitably secured to associated support means as comprised of, for example, bracket means 46 having a flange portion 48 through which is formed a clearance aperture for the reception therethrough of a portion of the apparatus 40. A suitable fastener, such as a nut 50, may be employed for retaining the assembly 40 to the support means 46.

Figure 2:
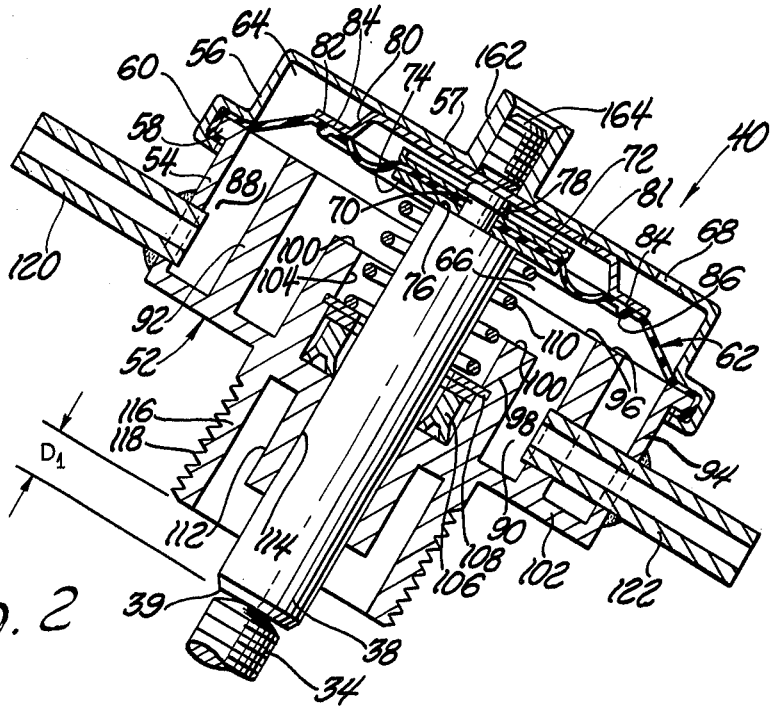
FIG. 2 is an enlarged axial cross-sectional view of the throttle stop assembly of FIG. 1 illustrating it in a first of its operating positions.

FIG. 2 illustrates the assembly 40 as comprising housing means 52 which, in turn, comprises cup-like housing sections or portions 54 and 56 which are secured to each other, as by a cooperating annular flange 58 and spun-over annular portion 60, as to generally peripherally sealingly contain a pressure responsive movable diaphragm means 62. As generally illustrated, the diaphragm means 62 defines generally oppositely disposed distinct but variable chambers 64 and 66 of which chamber 64 is vented, as by vent or passage means 68, to a source of relatively high pressure, such as ambient atmospheric pressure, while chamber 66 is, at least at times, placed in communication with a source of relatively low pressure, such as engine developed intake manifold pressure (or vacuum).

The pressure responsive movable wall means or diaphragm means 62 is secured as at its center to a necked-down end 70 of the axially positionable, generally cylindrical, stop member 38. The central portion of diaphragm means 62 is preferably contained and effectively clamped between opposed diaphragm backing plates 72 and 74 which are, in turn, clamped as against the annular shoulder 76 by the formed-over end portion 78.

A movable cup-like member 80 is provided as with an annular radiating flange portion 82 which is, in turn, suitably secured, preferably by cementing, to a juxtaposed annular portion 84 of diaphragm means 62.

The side of diaphragm means 62 opposite to the side thereof which is juxtaposed to cup-like member 80 is provided with an annular bead-like portion 86 which, preferably, is at least partially resiliently deflectable as to serve a sealing function to be described.

Chamber 66 may be considered as, in turn, defining two chamber sections 88 and 90. That is, a preferably annular wall 92 is formed within cup-like housing section 54 as to be spaced from and generally radially inwardly of the outer wall 94 of housing section 54. The inner wall 92 terminates in an annular end surface 96. As will become apparent, as the description progresses, the generally annular space between inner wall 92 and outer wall 94 comprises chamber section 88 while the space generally inwardly of inner wall 92 comprises chamber section 90.

A second generally radially inwardly situated wall 98 is provided which terminates in an end surface 100. The end surface 100 is, however, not in the same plane as end surface 96 but rather more closely situated to the end wall 102 of cup-like housing section 54.

In the preferred embodiment, the wall 98 also defines a generally axially extending recess 104 which accepts sealing means 106 and a snap-ring like annular retainer 108. Further, in the preferred embodiment, a spring means 110 is situated about member 38 and axially contained as between retainer 108 and diaphragm backing plate 74.

The end wall 102 is preferably provided with a generally axially extending bearing portion 112 through which is formed a passage or bearing surface 114 for the slidable reception therein of actuator member 38. Further, preferably, end wall 102 is provided with an axial extension 116 which is externally threaded as at 118 to thereby be able of threadable engagement with nut or fastener 50 (FIG. 1) for securing the assembly 40 to associated support means.

A first conduit portion 120 communicates with chamber 88 while a second conduit section 122 communicates with chamber 90.

OPERATION OF THE INVENTION

Referring to FIG. 2, let it be assumed that chambers 64 and 66, as well as chamber portions 88 and 90, are at ambient atmospheric pressure. At this time spring or resilient means 110 will be effective for causing end 78, of actuator member 38, to be moved against the cup-like member 80 causing both to be resiliently held against the end wall 57 of the cup-like housing section 56. As a consequence thereof, the end 39 of actuator member 38 assumes a first position which is arbitrarily designated, $D_1$.

Figure 3:
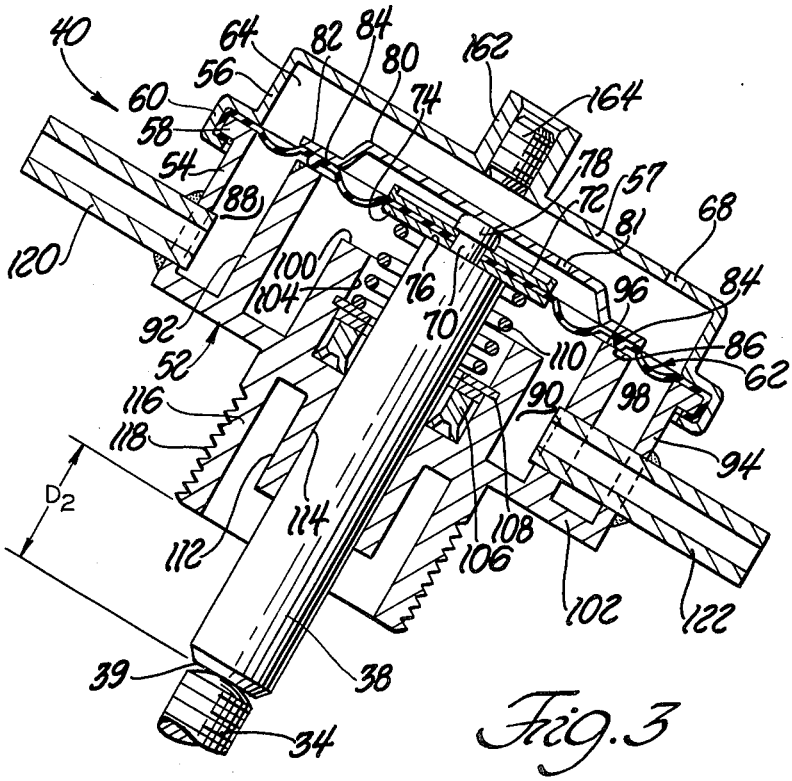
FIG. 3 is a view similar to that of FIG. 2 but illustrating the throttle stop assembly in a second of its operating positions.

If it is now assumed that flow through conduit means 122 is prevented and, further, that a first vacuum of a first magnitude is applied via conduit means 120, it can be seen that such first vacuum will, in effect, fill the entire chamber 66 including chamber portions 88 and 90 thereby, with the atmospheric pressure within chamber 64, creating a first pressure differential across the entire diaphragm means 62. Such pressure differential then causes diaphragm means 62 and diaphragm cup member 80 to move generally downwardly and correspondingly moving the actuator member 38. The diaphragm 62, actuator member 38 and cup member 80 continue such movement until the annular bead or sealing means 86 carried by diaphragm means 62 engages and seals against the end surface 96 of inner wall means 92. At this time, the magnitude of the vacuum applied to the annular portion of the diaphragm means which is generally juxtaposed to annular chamber portion 88 is sufficient to hold the diaphragm means 62 and the diaphragm cup-like plate member 80 in the second position as generally depicted in FIG. 3. As should be noted, when such a position as depicted in FIG. 3 is attained, chamber portions 88 and 90 are effectively sealed from each other by virtue of the sealing effect of annular bead or sealing means 86. Further, because flange 82 of cup-like member 80 is fixedly secured to that portion of diaphragm 62 which is in juxtaposition with such flange 82 and which carries the bead or sealing means 86, the member 80 is held in the position generally illustrated in FIG. 3 and thereby serves as an abutment against which the end 78 of actuator 38 acts. When the various elements attain their respective positions shown in FIG. 3, the actuator will have been moved further downwardly as to have its end 39 now at a distance $D_2$ which is greater than the distance $D_1$ of FIG. 2. In the preferred embodiment, sealing means 106 is such as to provide for a slight leakage therepast thereby enabling chamber portion 90 to become stabilized at ambient atmospheric pressure after diaphragm means 62 has been brought to the position shown in FIG. 3 wherein chamber portions 88 and 90 are sealed from each other by the annular bead or sealing means 86.

If it is now assumed that subsequently a second vacuum is applied via conduit means 122 to the chamber portion 90, the portion of diaphragm means 62 generally juxtaposed to chamber portion 90 is drawn further downwardly, past the plane of end surface 96, until the diaphragm backing plate 74 abuts against end surface 100 of wall portion 98. When such happens the various elements will have assumed their respective positions generally depicted in FIG. 4. The actuator 38 will have assumed its third position whereat end 39 thereof is at a distance, $D_3$, which is greater than distance $D_2$.

Figure 4:
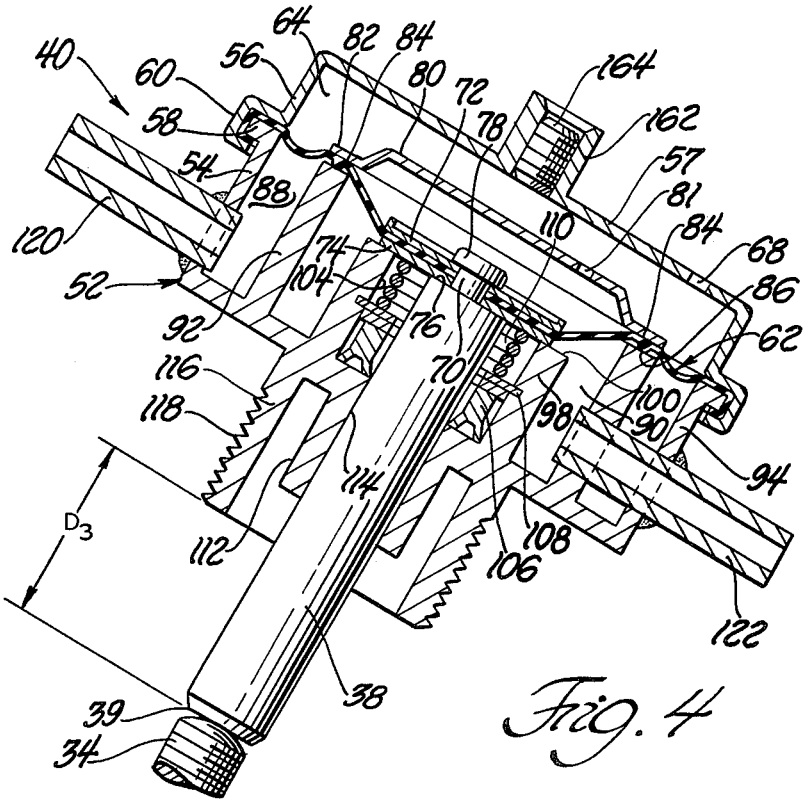
FIG. 4 is a view similar to each of FIGS. 2 and 3 but illustrating the throttle stop assembly in a third of its operating positions.

It should be observed that in the process of the elements moving from the second position, illustrated in FIG. 3, to the third position, illustrated in FIG. 4, the diaphragm cup-like member 80 does not change its position but rather stays in its FIG. 3 position effectively against the stop or abutment surface 96. However, the generally central portion of the diaphragm 62 (central with respect to the flange 82 of member 80) effectively moves away from cup-like member 80 since that portion of the diaphragm 62 is not directly secured to cup-like member 80. Suitable aperture or passage means 81 is formed in cup-like member 80 in order to permit the flow therethrough of the relatively high or ambient atmospheric pressure and the space generally between the central portion of diaphragm means 62 and the cup-like member 80.

Referring now to FIG. 1, along with FIGS. 2, 3 and 4, the engine 14 is illustrated as being operatively connected to vehicular ground-engaging drive wheels 120 and 122 as through suitable power transmission means 124. The vehicle is shown as also employing an air conditioning system 126 comprising, for example, clutch means 128 and related power transmission means 130 operatively connected to the engine 14. A source of electrical potential 132, grounded as at 134, is in circuit with a normally open electrical switch 136 and a normally closed electrical switch 138. The switches 136 and 138 are in series circuit with conductor means 140 leading to related actuator means 142.

Generally, when switch 136 is closed, by the vehicle operator, the circuit through actuator means 142 is completed resulting in such actuator means 142 causing, through transmission means 143, clutch means 128 to operatively engage and thereby, through power transmission means 130, drive the remaining air conditioning system means as, for example, the compressor.

Switch 138 may be of the type which opens upon associated temperature responsive means 144 sensing that the vehicle passenger compartment has reached some preselected temperature. Upon switch 138 being opened, the circuit to the actuator means 142 is opened and clutch means 128 becomes disengaged.

A suitable, for example, solenoid type valve assembly 146 is shown being electrically in circuit, as by conductor means 148, with conductor means 140 and actuator means 142. Whenever the conductor means 140 is closed, valving means 146 is actuated as to thereby complete communication as between conduit means 122 and a source of engine intake manifold vacuum as via conduit means 150 and 152. The other end 154 of conduit means 152 may be tightly received as within a passage 156 leading to the interior 22 of intake manifold means 12.

Second valving means 158, which may either be, for example, directly responsive to the intake manifold vacuum attaining a preselected magnitude or controlled by related pressure sensitive transducer means, is effective for at times completing communication as between conduit means 120 and a source of engine vacuum as via conduit means 160, 162 and 152.

Assuming now that the engine 14 is at normal operating temperature and operating at curb idle and further assuming that switch 136 is open, there will be no vacuum communication from the intake manifold 12 to either of conduits 120 and 122 and therefore there will be no vacuum communicated to either chamber portions 88 or 90 of chamber 66. Consequently, the return spring 29, of throttle means 18, will rotate and urge stop screw 34 against the stop or actuator member 38 so as to have the respective elements assume their positions as depicted in FIG. 2 which may be considered the throttle idle position of the engine induction means 10. The opening of the throttle means 18 will be the smallest amount reflective of the smallest dimension, $D_1$, of FIG. 2.

Now let it be assumed that the vehicle is operating at normal road load and at a speed of, for example, 55 m.p.h. Further, let it be assumed that the operator lets the throttle valve means 18 return toward its normally closed or idle position so that, in effect the vehicle is driving the engine while undergoing deceleration. When this happens the magnitude of the manifold vacuum increases to a very high magnitude and if the throttle means 18 remained at normal idle position, excessive amounts of fuel would be drawn from idle fuel metering system into the engine. If it is assumed that such a closed throttle during vehicle deceleration would result in a manifold vacuum in the order of 24.0 inches of Hg, then let it be assumed that the valving means 158 completes communication between conduit means 162 and conduit means 160 and 120 at a manifold vacuum in the order of, for example, 19.0 inches of Hg. Consequently, as the throttle is permitted, by the operator, to return toward idle position (with the vehicle driving the engine) the magnitude of the manifold vacuum starts to increase and when such reaches the (assumed) magnitude of 19.0 inches of Hg. valving means 158 directs vacuum to and through conduit means 120 and into the general chamber 66 including chamber portions 88 and 90. This then causes the elements of the actuator 40 to assume the respective positions shown in FIG. 3 (as previously described) with the result that actuator member 38 and 39 has moved to a distance $D_2$ thereby engaging and moving throttle stop screw 34 and causing, through lever means 24, a slight clockwise (as viewed in FIG. 1) opening rotation of throttle valve means 18. As a result, the throttle valve 18 is held slightly more open than it would otherwise be in its normal idle position and the manifold vacuum is precluded from becoming excessive and drawing-in excessive rates of fuel flow through the idle fuel metering system. The catalytic converter overheats during long decelerations such as long downhill grades. This is because of the low air flow and relative rich mixture with resulting unburned hydrocarbons and carbon monoxides that burn in the converter. With a more open throttle the mixture is a little leaner and the overheating problem is eliminated.

Let it be assumed now that the engine 14 is operating at, for example, curb idle (the elements being in positions depicted in FIGS. 1 and 2) and, further, that the vehicle operator has closed switch 136 thereby causing clutch means 128 to become engaged and the air conditioning system 126 to be operative. As a consequence thereof the valve means 146 completes communication as between conduit 152 and 122, via conduit 150, thereby applying such manifold vacuum to chamber 66 and chamber portions 88 and 90 thereof. The thusly applied manifold vacuum causes diaphragm means 62 to move from the FIG. 2 position to the FIG. 3 position and continue until the diaphragm backing plate 74 abuts against the stop or abutment surface 100 as illustrated in FIG. 4. As already noted, the end 39 of actuator 38 moves to a position corresponding to distance $D_3$ thereby moving the throttle valve 18, through throttle stop screw 34 and lever means 24, to a selected greater opening thereby providing for a greater (greater than the normal idle throttle setting) rate of flow of motive fluid to the engine in order to compensate for the increased engine load brought about by the energization of the air conditioning system 126. Of course, if and when switch 138 is opened, the clutch means 128 becomes disengaged and valve means 146 ceases conveying vacuum to chamber 90 and the diaphragm means 62 and actuator means 38 return to the position depicted in FIG. 1.

If desired, end wall 57 of housing section 56 may be provided with an internally threaded portion or extension 162 which threadably receives therein an adjustment screw, as for example, in the form of an allen screw 164. Such adjustment screw 164 may be employed as an adjustment means for selectively adjustably determining where the diaphragm cup-like member 80 and diaphragm means 62 will stop in their movement toward the wall 57 of housing section 54.

Although only a preferred embodiment and selected modifications of the invention have been disclosed and described, it is apparent that other embodiments and modifications of the invention are possible within the scope of the appended claims.

What is claimed is:

1. Apparatus for variably stopping the closing movement of throttle valve means controlling the flow of motive fluid to an associated combustion engine, comprising variably positionable abutment means effective for operative engagement with said throttle valve means when said throttle valve means is moved toward a closed position, said abutment means when in a first position being operatively engagable by said throttle valve means when said throttle valve means is moved to a normal idle throttle position, said abutment means being effective when in said first position to hold open said throttle valve means a relatively small first amount, pressure responsive movable wall means effective upon being exposed to a first vacuum generated by said engine for moving said abutment means to a second position whereat said throttle valve means when moved toward said closed position operatively engages said abutment means to thereby be held open a relatively larger second amount, said pressure responsive movable wall means being effective upon being exposed to a second vacuum generated by said engine for moving said abutment means to a third position whereat said throttle valve means is held open a relatively greatest third amount, and resilient means, said resilient means being the only resistive means effective to operatively resiliently resist the movement of said abutment means from said first position to said second position and from said second position to said third position, said resilient means exhibiting only a single spring rate and being devoid of abrupt changes in the spring rate thereof during the entire distance of movement of said abutment means from said first position to said third position.

2. Apparatus according to claim 1 wherein said pressure responsive movable wall means comprises pressure responsive movable diaphragm means.

3. Apparatus according to claim 1 wherein said resilient means comprises a single spring member.

4. Apparatus according to claim 3 wherein said pressure responsive movable wall means comprises pressure responsive movable diaphragm means.

5. Apparatus for variably stopping the closing movement of throttle valve means controlling the flow of motive fluid to an associated combustion engine, comprising variably positionable abutment means effective for operative engagement with said throttle valve means when said throttle valve means is moved toward a closed position, said abutment means when in a first position being operatively engagable by said throttle valve means when said throttle valve means is moved to a normal idle throttle position, said abutment means being effective when in said first position to hold open said throttle valve means a relatively small first amount, pressure responsive movable wall means effective upon being exposed to a first vacuum generated by said engine for moving said abutment means to a second position whereat said throttle valve means when moved toward said closed position operatively engages said abutment means to thereby be held open a relatively larger second amount, said pressure responsive movable wall means being effective upon being exposed to a second vacuum generated by said engine for moving said abutment means to a third position whereat said throttle valve means is held open a relatively greatest third amount, said pressure responsive movable wall means comprising pressure responsive movable diaphragm means, housing means, said housing means comprising first and second housing sections, wherein said housing sections are held together and generally peripherally retain and contain said diaphragm means, wherein said diaphragm means cooperates with said first housing section to define a first chamber means generally therebetween, wherein said diaphragm means cooperates with said second housing section to define a second chamber means generally therebetween, wherein said second chamber means comprises first and second chamber portions, wherein said second housing section comprises an axial end wall, wherein said abutment means is slidably received through said axial end wall and operatively connected to said diaphragm means, first passage means for communicating said first vacuum to said first chamber portion, and second passage means for communicating said second vacuum to said second chamber portion.

6. Apparatus according to claim 5 wherein said second housing section comprises an inner-situated wall, wherein said inner-situated wall generally separates said first chamber portion from said second chamber portion, and wherein said second passage means comprises conduit means extending through said inner-situated wall.

7. Apparatus for variably stopping the closing movement of throttle valve means controlling the flow of motive fluid to an associated combustion engine, comprising variably positionable abutment means effective for operative engagement with said throttle valve means when said throttle valve means is moved toward a closed position, said abutment means when in a first position being operatively engagable by said throttle valve means when said throttle valve means is moved to a normal idle throttle position, said abutment means being effective when in said first position to hold open said throttle valve means a relatively small first amount, pressure responsive movable wall means effective upon being exposed to a first vacuum generated by said engine for moving said abutment means to a second position whereat said throttle valve means when moved toward said closed position operatively engages said abutment means to thereby be held open a relatively larger second amount, said pressure responsive movable wall means being effective upon being exposed to a second vacuum generated by said engine for moving said abutment means to a third position whereat said throttle valve means is held open a relatively greatest third amount, said pressure responsive movable wall means comprising pressure responsive movable diaphragm means, and housing means, said housing means comprising first and second housing sections, wherein said housing sections are held together and generally peripherally retain and contain said diaphragm means, wherein said diaphragm means cooperates with said first housing section to define a first chamber means generally therebetween, wherein said diaphragm means cooperates with said second housing section to define a second chamber means generally therebetween, wherein said second chamber means comprises first and second chamber portions, wherein said second housing section comprises an inner-situated annular wall having an annular end surface, wherein said annular wall generally separates said first chamber portion from said second chamber portion, and wherein a portion of said diaphragm means is operatively in abutting relationship to said annular end surface when said abutment means is in said second position.

8. Apparatus according to claim 7 and further comprising sealing means carried by said diaphragm means, said sealing means being effective to operatively engage said annular end surface and effectively seal said first chamber portion from said second chamber portion when said portion of said diaphragm means is operatively in abutting relationship to said annular end surface.

9. Apparatus according to claim 8 wherein said sealing means comprises resiliently deflectable bead-like means carried by said diaphragm means.

10. Apparatus according to claim 8 wherein said sealing means comprises resiliently deflectable annularly continuous bead-like means carried by said diaphragm means.

11. Apparatus for variably stopping the closing movement of throttle valve means controlling the flow of motive fluid to an associated combustion engine, comprising variably positionable abutment means effective for operative engagement with said throttle valve means when said throttle valve means is moved toward a closed position, said abutment means when in a first position being operatively engagable by said throttle valve means when said throttle valve means is moved to a normal idle throttle position, and abutment means being effective when in said first position to hold open said throttle valve means a relatively small first amount, pressure responsive movable wall means effective upon being exposed to a first vacuum generated by said engine for moving said abutment means to a second position whereat said throttle valve means when moved toward said closed position operatively engages said abutment means to thereby be held open a relatively larger second amount, said pressure responsive movable wall means being effective upon being exposed to a second vacuum generated by said engine for moving said abutment means to a third position whereat said throttle valve means is held open a relatively greatest third amount, said pressure responsive movable wall means comprising pressure responsive movable diaphragm means, and housing means, said housing means comprising first and second housing sections, wherein said housing sections are held together and generally peripherally retain and contain said diaphragm means, wherein said diaphragm means cooperates with said first housing section to define a first chamber means generally therebetween, wherein said diaphragm means cooperates with said second housing section to define a second chamber means generally therebetween, wherein said second chamber means comprises first and second chamber portions, wherein said second housing section comprises an inner-situated first wall having a first end surface, wherein said second housing section comprises an inner-situated second wall having a second end surface, wherein said first wall generally separates said first chamber portion from said second chamber portion, wherein a first portion of said diaphragm means is operatively in abutting relationship with said first end surface when said abutment means is in said second position, and wherein a second portion of said diaphragm means is operatively in abutting relationship with said second end surface when said abutment means is in said third position.

12. Apparatus according to claim 11 and further comprising sealing means carried by said diaphragm means, said sealing means being effective to operatively engage said first end surface and effectively seal said first chamber portion from said second chamber portion when said portion of said diaphragm means is operatively in abutting relationship to said annular end surface.

13. Apparatus according to claim 12 wherein said sealing means comprises resiliently deflectable bead-like means carried by said diaphragm means.

14. Apparatus according to claim 12 wherein said sealing means comprises resiliently deflectable annular continuous bead-like means carried by said diaphragm means.

15. Apparatus according to claim 11 and further comprising diaphragm plate means, said plate means being secured along a generally annular path to said diaphragm means.

16. Apparatus according to claim 15 wherein said annular path is generally juxtaposed to said first portion of said diaphragm means.

17. Apparatus according to claim 15 wherein said plate means comprises a generally annular radiating flange portion, and wherein said plate means is secured along a generally annular path to said diaphragm means by virtue of said flange portion being cemented to said diaphragm means.

18. The combination of a vehicle, ground engaging drive wheel means, a combustion engine, induction means, said induction means comprising engine intake manifold means and apparatus for supplying motive fluid to said intake manifold means and said engine, variably positionable throttle valve means in said apparatus, linkage means operatively connected to said throttle valve means for selectively variably positioning said throttle valve means, air conditioning system means, power transmitting means for supplying driving power from said engine to said air conditioning system means, and means for positioning said throttle valve means into any of at least three positions depending upon indicia of engine load, wherein said means for positioning said throttle valve means comprises pressure responsive motor means, said motor means being effective to permit said throttle valve means to assume a first position whenever the magnitude of the intake manifold vacuum is less than a preselected minimum magnitude and said air conditioning system means is not being driven by said power transmitting means, said motor means being effective to cause said throttle valve means to assume a second position whenever the magnitude of the intake manifold vacuum is greater than at least said preselected minimum magnitude and said air conditioning system means is not being driven by said power transmitting means, and said motor means being effective to cause said throttle valve means to assume a third position whenever said air conditioning system means is being driven by said power transmitting means, wherein said pressure responsive motor means comprises pressure responsive movable diaphragm means, and further comprising a plurality of stops against which said diaphragm means operatively abuts as to determine at least said second and third positions, and resilient means, said resilient means being the only resistive means effective to operatively resiliently resist the movement of said movable diaphragm means from a position corresponding to said first position to a position corresponding to said third position, said resilient means exhibiting only a single spring rate and being devoid of abrupt changes in the spring rate thereof during the entire distance of movement of said movable diaphragm means from said position corresponding to said first position to said position corresponding to said third position.

* * * * *